US009482220B2

(12) United States Patent
Stephens

(10) Patent No.: US 9,482,220 B2
(45) Date of Patent: Nov. 1, 2016

(54) DUAL REDUNDANCY IN FIRE PUMP CONTROLLERS

(71) Applicant: Douglas A. Stephens, Cary, NC (US)

(72) Inventor: Douglas A. Stephens, Cary, NC (US)

(73) Assignee: ASCO Power Technologies, L.P., Florham Park, NJ (US)

( * ) Notice: Subject to any disclaimer, the term of this patent is extended or adjusted under 35 U.S.C. 154(b) by 294 days.

(21) Appl. No.: 13/908,934

(22) Filed: Jun. 3, 2013

(65) Prior Publication Data

US 2013/0343911 A1 Dec. 26, 2013

Related U.S. Application Data

(60) Provisional application No. 61/656,779, filed on Jun. 7, 2012.

(51) Int. Cl.

*F04B 49/06* (2006.01)
*F04B 49/00* (2006.01)
*F04B 49/08* (2006.01)

(52) U.S. Cl.

CPC ..... *F04B 49/00* (2013.01); *F04B 49/06* (2013.01); *F04B 49/08* (2013.01); *F04B 2205/05* (2013.01)

(58) Field of Classification Search

CPC ..... F04B 49/065; F04B 2205/04; F04B 2205/05; F04B 49/08; F04B 49/06; A62C 35/64

USPC ..... 700/282

See application file for complete search history.

(56) References Cited

U.S. PATENT DOCUMENTS

| | | | |
|---|---|---|---|
| 3,748,656 | A | 7/1973 | Gray et al. |
| 5,035,357 | A | 7/1991 | Brickell et al. |
| 5,236,049 | A | 8/1993 | Asselin et al. |
| 5,460,196 | A | 10/1995 | Yonnet |
| 5,577,890 | A | 11/1996 | Nielsen et al. |

(Continued)

FOREIGN PATENT DOCUMENTS

| | | | |
|---|---|---|---|
| EP | 1702655 | A1 | 9/2006 |
| JP | 2009008091 | A1 | 1/2009 |

OTHER PUBLICATIONS

Firetrol, Inc., Instructions, Digital Pressure Monitor, FTA470, Publication NS470-01 Rev. A (Oct. 20, 2000).

(Continued)

*Primary Examiner* — Charles Freay
*Assistant Examiner* — Philip Stimpert
(74) *Attorney, Agent, or Firm* — McDonnell Boehnen Hulbert & Berghoff LLP

(57) ABSTRACT

Example devices, systems, and methods disclosed herein relate to controlling operation of a fire pump or jockey pump of a fire pump system. An example fire pump control system may comprise a jockey pump controller configured to control operation of a jockey pump and a fire pump controller configured to control operation of a fire pump. The jockey pump controller may be configured to determine a first pressure value based on an output of a jockey pump pressure sensor. The fire pump controller may be configured to receive the first pressure value from the jockey pump controller. The fire pump controller may also be configured to determine a second pressure value based on an output of a fire pump pressure sensor and select a predetermined action based on a comparison of the first pressure value and the second pressure value. Additional example devices, systems, and methods are described herein.

10 Claims, 7 Drawing Sheets

(56) References Cited

U.S. PATENT DOCUMENTS

| | | | | |
|---|---|---|---|---|
| 5,729,698 | A | 3/1998 | Stelter | |
| 5,950,150 | A | 9/1999 | Lloyd et al. | |
| 5,982,274 | A | 11/1999 | Stelter et al. | |
| 6,221,263 | B1 | 4/2001 | Pope et al. | |
| 6,273,686 | B1 | 8/2001 | Kroell et al. | |
| 6,434,456 | B1 * | 8/2002 | Babala et al. | 701/29.2 |
| 6,856,251 | B1 | 2/2005 | Tietsworth et al. | |
| 6,992,590 | B1 | 1/2006 | Tietsworth et al. | |
| 2005/0183868 | A1 | 8/2005 | Taylor et al. | |
| 2010/0138054 | A1 * | 6/2010 | Goupil | 700/282 |

OTHER PUBLICATIONS

Torna Tech, JP Model, Jockey Pump Controller, Full voltage across the line starter Mico Processor Based, JP-BRO-001/E Rev.4 (Sep. 4, 2003).

U.S. Appl. No. 12/626,781, Office Action dated Sep. 30, 2011.

U.S. Appl. No. 12/626,781, Office Action dated Jun. 8, 2012.

* cited by examiner

DUAL REDUNDANCY IN FIRE PUMP CONTROLLERS

CROSS-REFERENCE TO RELATED APPLICATION

This application is a non-provisional of U.S. Provisional Patent Application No. 61/656,779, filed Jun. 7, 2012, which is incorporated herein by reference in its entirety.

BACKGROUND

A fire protection system may comprise a sprinkler system and/or a standpipe system. A sprinkler system is an active fire protection measure that provides adequate pressure and flow to a water distribution piping system, onto which a plurality of fire sprinklers is connected. Each closed-head sprinkler can be triggered once an ambient temperature around the sprinkler reaches a design activation temperature of the individual sprinkler head. In a standard wet-pipe sprinkler system, each sprinkler activates independently when the predetermined heat level is reached. Because of this, the number of sprinklers that operate is limited to only those near the fire, thereby maximizing the available water pressure over the point of fire origin. A standpipe system is another type of fire protection measure consisting of a network of vertical piping installed in strategic locations within a multi-story building. The vertical piping may deliver large volumes of water to any floor of the building to supply hose lines of firefighters, for example.

FIG. 1 illustrates a block diagram of a prior art fire pump installation 100. The fire pump installation 100 includes an electric motor driven fire pump 102 which is driven by an electric motor. The electric motor driven fire pump 102 is further connected to a water source 104. The water source 104 provides water flow at a pressure to a fire protection system 106. Generally, fire pumps are needed when a water source cannot provide sufficient pressure to meet hydraulic design requirements of a fire protection system. This usually occurs in a building that is tall, such as a high-rise building, or in a building that requires a relatively high terminal pressure in the fire protection system 106 to provide a large volume of water, such as a storage warehouse.

The fire pump 102 starts under operation of the electric motor when a pressure in the fire protection system 106 drops below a certain predetermined start pressure. A pressure sensing line 118 is provided which allows the fire pump controller 110 to monitor system pressure. For example, the pressure in the fire protection system 106 may drop significantly when one or more fire sprinklers are exposed to heat above their design temperature, and open, releasing water. Alternately, fire hose connections to standpipe systems may be opened by firefighters causing a pressure drop in the fire protection system 106. In one instance, the fire pump may have a rating between 3 and 3500 horsepower (HP).

The fire pump installation 100 also includes an electric motor driven pressure maintenance pump, which also may be referred to as a make-up pump or a jockey pump 108. Under operation of an electric motor, the jockey pump 108 is intended to maintain pressure in the fire protection system 106 so that the fire pump 102 does not need to constantly run. A pressure sensing line 120 is provided which allows the jockey pump controller 108 to monitor system pressure. For example, the jockey pump 106 maintains pressure to an artificially high level so that the operation of a single fire sprinkler will cause a pressure drop that will be sensed by a fire pump controller 110, causing the fire pump 102 to start. In some examples, the jockey pump 108 may have a rating between ¼ and 100 HP.

In one example, the jockey pump 108 may provide makeup water pressure for normal leakage within the system (such as packing on valves, seepage at joints, leaks at fire hydrants) and inadvertent use of water from the water source 104. When the fire pump 102 starts, a signal may be sent to an alarm system of a building to trigger a fire alarm. Nuisance operation of the fire pump 102 (as well as the electric motor operating the fire pump 102) may eventually cause fire department intervention and increase wear on the fire pump 102. Thus, it is generally desired to either reduce and/or avoid any nuisance or unintended operation of the fire pump 102 and the accompanying fire pump motor.

The jockey pump 108 may also include a jockey pump controller 112. Each of the fire pump controller 110 and jockey pump controller 112 may comprise a microprocessor-based controller that can be used to adjust start and stop set points. For example, the fire pump controller 110 may automatically cause the fire pump 102 to start or the jockey pump controller 112 may automatically cause the jockey pump 108 to start when a water pressure is below a pressure set point. The jockey pump controller 112 may have a start pressure set point of approximately five to ten pounds per square inch (psi) greater than the start pressure point of the fire pump controller 110. In this manner, the jockey pump controller 112 cycles the jockey pump to maintain the fire protection system 106 at a predetermined pressure well above the start setting of the fire pump 102 so that the fire pump 102 only runs when a fire occurs or the jockey pump 108 is overcome by a larger than normal loss in system pressure.

The fire installation system 100 also includes check valves 114 and gate valves 116. The check valves 114 are used in the fire pump installation 100 to allow the flow of water in one direction only for the purpose of building pressure in the fire protection system 106. Check valves 114 are installed between the outlets of each of the fire pump 102 and jockey pump 108, and the fire protection system 106. The gate valves 116 are installed on the inlets and outlets of each of the fire pump 102 and jockey pump 108 and are used to isolate either the fire pump 102 or jockey pump 108 from the fire protection system 106 and water source 104 for maintenance or other purposes.

SUMMARY

In one example aspect, a fire pump control system is provided that comprises a jockey pump controller configured to control operation of a jockey pump and a fire pump controller configured to control operation of a fire pump. The jockey pump controller may be configured to determine a first pressure value based on an output of a jockey pump pressure sensor. The fire pump controller may be configured to receive the first pressure value from the jockey pump controller. The fire pump controller may also be configured to determine a second pressure value based on an output of a fire pump pressure sensor, and determine a predetermined action based on a comparison of the first pressure value and the second pressure value.

In another example aspect, a fire pump controller configured to control operation of a fire pump system is provided. The fire pump controller may comprise a pressure transducer that is configured to generate a first pressure signal based on a pressure of the fire pump system. The fire pump controller may also comprise a processor that is configured to determine a first pressure value based on the first pressure signal. The processor may also be configured to receive via a wired communication link a second pressure value. The second pressure value may be indicative of a second pressure signal from a pressure transducer of a jockey pump controller, for instance. Additionally, the processor may be configured to determine an action for the fire pump system based on a comparison of the first pressure value and the second pressure value.

In still another example aspect, a non-transitory computer-readable medium having stored therein instructions executable by a computing device to cause the computing device to control operation of a fire pump system is provided. The instructions may be effective to cause the computing device to perform functions comprising determining a first pressure value based on a first pressure signal output from a fire pump pressure sensor, and receiving a second pressure value from a jockey pump controller. The functions may also include comparing the first pressure value and the second pressure value, and determining an action for the fire pump system based on the comparison and a configuration setting of a fire pump controller.

The foregoing summary is illustrative only and is not intended to be in any way limiting. In addition to the illustrative aspects, embodiments, and features described above, further aspects, embodiments, and features will become apparent by reference to the figures and the following detailed description.

DETAILED DESCRIPTION

Figure 1:
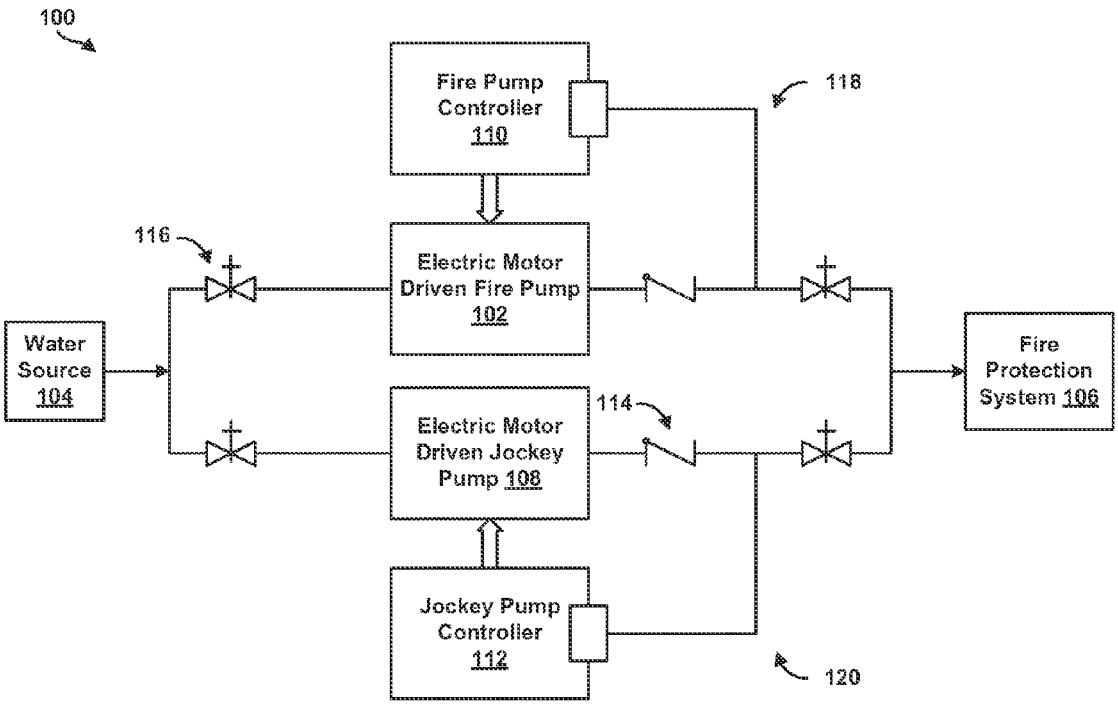
FIGURE 1 Prior Art
FIG. 1 is a block diagram of a prior art fire pump installation.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

Example devices, systems, and methods disclosed herein relate to controlling operation of a fire pump or jockey pump of a fire pump system. An example fire pump control system may comprise a jockey pump controller for controlling operation of a jockey pump and a fire pump controller for controlling operation of a fire pump. A communication link may be provided between the jockey pump controller and the fire pump controller to permit the exchange of pressure values and pressure set points, and/or exchange of other information as well. In some examples, the exchange of pressure values and pressure set points may enable the use of voting logic in one or more of the fire pump controller and the jockey pump controller to determine a course of action in case a pressure sensor of the fire pump controller or the jockey pump controller has failed.

As an example, the jockey pump controller may be configured to determine a first pressure value based on an output of a jockey pump pressure sensor and send the first pressure value to the fire pump controller. The fire pump controller may subsequently determine a second pressure value, based on an output of a fire pump pressure sensor, and select a predetermined action based on a comparison between the first pressure value and the second pressure value.

In a further example, the fire pump controller may be further configured to send the second pressure value to the jockey pump controller. This may enable the jockey pump controller to select another action for the fire pump system, optionally in parallel with the selection by the fire pump controller, based on a second comparison between the second pressure value and a pressure set point for the fire pump controller. Additional example devices, systems, and methods are described herein.

Figure 2:
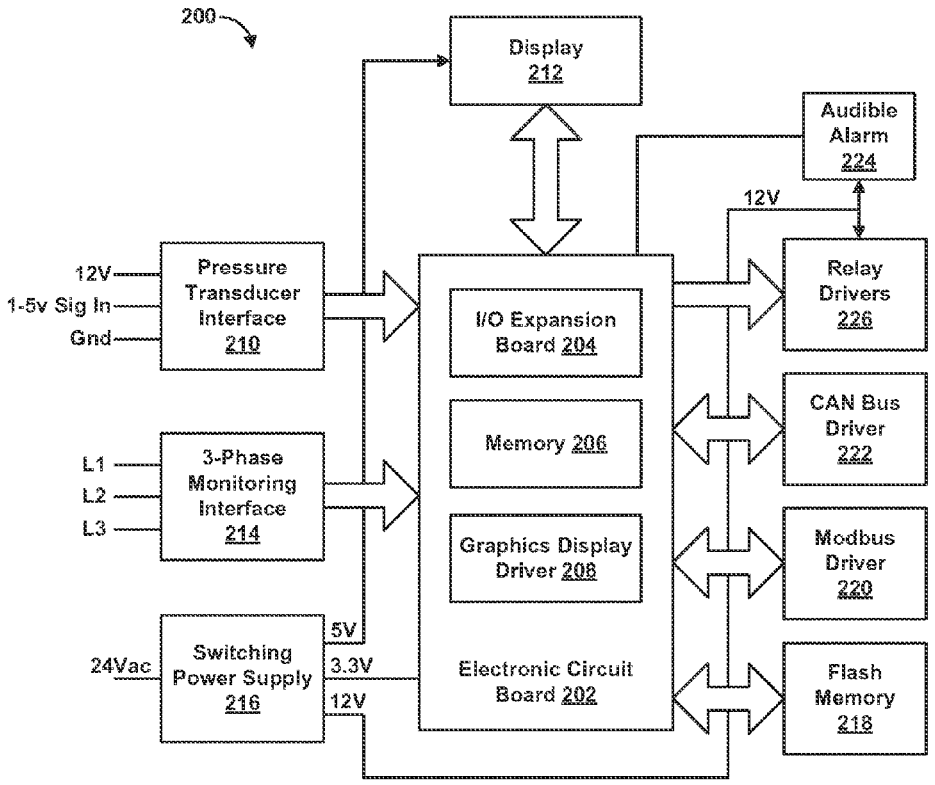
FIG. 2 is a block diagram illustrating an example pump controller system configured to control a pump to maintain water pressure within a water system.

Referring again to the figures, FIG. 2 is a block diagram illustrating an example pump controller system 200 configured to control a pump to maintain water pressure within a water system. For example, the water system may be the fire protection system 106 of FIG. 1. In some examples, the system 200 may include one or more functional or physical components, such as an electronic circuit board 202 and a pressure transducer interface 210. One or more of the described functional or physical components may be divided into additional functional or physical components, or combined into fewer functional or physical components. Additionally, the system 200 may include more or less functional and/or physical components.

In some examples, the electronic circuit board 202 of the system may optionally include an input/output (I/O) expansion board 204. For instance, a ribbon cable may connect the electronic circuit board 202 to the I/O expansion board 204, and the I/O expansion board 204 may be configured to provide additional processing capabilities for the electronic circuit board 202. The electronic circuit board 202 and/or the I/O expansion board 204 may be a microprocessor, or functions of the electronic circuit board 202 and/or the I/O expansion board 204 may be performed by a microprocessor. Depending on the desired configuration, any type of microprocessor(s) may be included, including but not limited to a microprocessor, a microcontroller, a digital signal processor, or any combination thereof. The electronic circuit board 202 and/or the I/O expansion board 204 may include one or more levels of caching, a processor core, and registers. The processor core can include an arithmetic logic unit, a floating point unit, a digital signal processing core, or any combination thereof. In one example, the microprocessor comprises a TMS470-based microcontroller. In some examples, the functions of the microprocessor may be provided by multiple microprocessors.

The electronic circuit board 202 may also include a memory 206, such as for example, volatile memory (e.g., random access memory), non-volatile memory (e.g., read only memory, flash memory, etc.) or any combination thereof. The memory 206 may include stored software applications, and the electronic circuit board 202 or components of the electronic circuit board 202 may be configured to access the memory 206 and execute one or more of the software applications stored therein. Additionally, the electronic circuit board 202 may include a graphics display driver 208, utilized to drive a display 212 of the system or an external display for a PC, laptop, video monitor, television, or similar monitor device. Such displays may be provided locally at a location of the system 200 or remotely.

The electronic circuit board 202 may receive electronic signals from the pressure transducer interface 210 indicating a pressure value, and compare the pressure value to a set point for starting or stopping a pump motor. For example, the system 200 may be a fire pump controller controlling a motor of a fire pump or a jockey pump controller controlling a motor of a jockey pump. In one example, the electronic circuit board 202 may output a pump run signal to energize a motor contactor coupled to the pump motor.

The pressure transducer interface 210 may be configured to receive a signal from a pressure transducer. For instance, the pressure transducer may be any type of pressure sensor which may generate a signal as a function of an imposed pressure, and provide an input to the electronic circuit board 202 via the pressure transducer interface 210. As such, the pressure transducer may be positioned in a water system to generate signals as a function of a suction pressure at the inlet of the pump, a discharge pressure at the outlet of a pump, an overall system pressure, or other water pressure. The pressure transducer may be any kind of pressure sensor that may measure any type of pressure, such as an absolute pressure, a gauge pressure, a differential pressure, or a sealed pressure, for example.

In one example, the pressure transducer may be an electronic pressure sensor using a linear variable differential transformer (LVDT) coupled to a bourbon tube. In other examples, the pressure transducer may be a solid state pressure sensing device, an electromechanical pressure sensing device, or a combination of the two. For example, the solid state pressure sensing device may comprise a semiconductor pressure transducer that includes an integrated circuit having a four resistor bridge implanted on a silicone membrane.

In some examples, the pressure transducer may include a range of 0-300 psi, 0-600 psi, or 0-1000 psi for fresh water service, sea water/foam service, or other service. Other example pressure ranges within or outside of the example pressure ranges are also possible. In one instance, the pressure transducer interface may provide an analog voltage of about 1-5 volts of direct current that can be interpreted by the pressure transducer interface 210 or the electronic circuit board 202 as indicating a corresponding water pressure between 0-600 psi.

In some instances, the pressure transducer may be included within an enclosure of the system 200. In other instances, the pressure transducer may be mounted outside the enclosure of the system 200 and is operationally coupled to the system 200.

The system 200 may further include a three-phase monitoring interface 214 that may provide inputs to the electronic circuit board 202 or components of the electronic circuit board 202. For example, the three-phase monitoring interface 214 may monitor a three-phase power line for detection of phase failure or phase reversal. As an example, the electronic circuit board 202 may receive a signal(s) from the three-phase monitoring interface 214 and a microprocessor may determine whether there is a valid supply line with all three phases present, a correct phase rotation, and a proper frequency.

The electronic circuit board 202 may be powered by a switching power supply 216 that is configured to receive a single phase 24 volt alternating current (Vac) control voltage and output appropriate voltage values to power components of the system 200. For example, a transformer may be connected between two phases of a three-phase incoming line (such as a 200-600 Vac 50/60 hertz (Hz) line), and convert the line voltage to the 24 Vac control voltage. Additionally, the power switching supply 216 may provide voltages such as 5 volts, 3.3 volts, or 12 voltages to components of the system 200. Other voltages are also possible.

In some examples, the electronic circuit board 202 may receive or output information (such as analog and/or digital signals) from or to components of the system 200. For example, a microprocessor may receive inputs or configuration settings via a user interface or input device. In other examples, the electronic circuit board 202 may communicate with a flash memory 218 to store operating conditions of the system 200 or communicate using one or more of a Modbus driver 220, controller area network (CAN) bus driver 222, or other communication component. Serial network communications may take place, for example, with other systems 200 or a local or remote computing device. Other communication interface drivers may also provide for communication using Modbus Ethernet, CANOpen, wired or wireless Ethernet, DeviceNet, ProfiBus, BACNet, ARCNet, ZigBee, Bluetooth, Wi-Fi, and other similar protocol structures.

The electronic circuit board 202 or components of the electronic circuit board 202 may also output signals to an audible alarm 224 or the display 212 to provide audible or visual indications of operation of the system 200, for example.

The electronic circuit board 202 or components of the electronic circuit board 202 may also output to relay drivers 226 for operating drivers to actuate relays. For instance, a microprocessor may output a pump run signal for operating a pump motor on the three-phase incoming line, such as by initializing the three-phase incoming line to provide power to the pump motor. In one example, the relay drivers 226 may be instructed to operate the relays until a signal is received from the electronic circuit board 202 indicating that a pressure value is satisfied and a minimum run timer has expired. The relays may include any type of switch or electrically operated switch, for example.

In some examples, a microprocessor of the electronic circuit board 202 may implement a control sequence by way of a software-based state machine. In one state machine arrangement, the state machine comprises at least three states: an Idle, a Starting State, and a Running State. For example, in the Idle State, a pump motor will not be energized and hence the pump will not be running. However, in one operational arrangement, the state machine monitors various discrete and measured data points to determine whether conditions exist to advance to a subsequent state, such as the Starting State.

During the Starting State, the control logic of the microprocessor will account for timers and/or configuration options that might be intended to delay or inhibit a state transition. The Starting State contains the logic associated with the proper startup of a pump. A successful detection of an active pump may cause the state to transition to the Running State. Failure to start the pump or pumps will likewise be detected and may result in certain alarm indications. As just one example, a failure to start alarm may be declared if a 24Vac signal is not received from an auxiliary contact within a certain predetermined time frame (e.g., within 1 second of energizing).

In the Running State, the pump will be active. During the Running State, the state machine can monitor various discrete and measured data points to determine whether conditions exists to stop the pump and, as such, advance the control to an Idle State. During the Running State, the microprocessor based logic will also account for any timers or configuration options intended to delay or inhibit a state transition of the pump.

The system 200 may also comprise a plurality of programmable timers. In one system arrangement, control sequence timers may be provided. The control sequence timers may interact with the pump control state machine and may comprise either an On Delay Timer or a Minimum Run Timer. The On Delay Timer can be used to guard against nuisance activations of the pump due to pressure excursions such as water hammer. The Minimum Run Timer may be used to specify a minimum length of time the pump is kept running. For example, the system 200 can be programmed so that it can keep the pump running until the minimum run timer has expired and a STOP pressure within a fire protection system has been maintained and is therefore satisfied.

Figure 3:
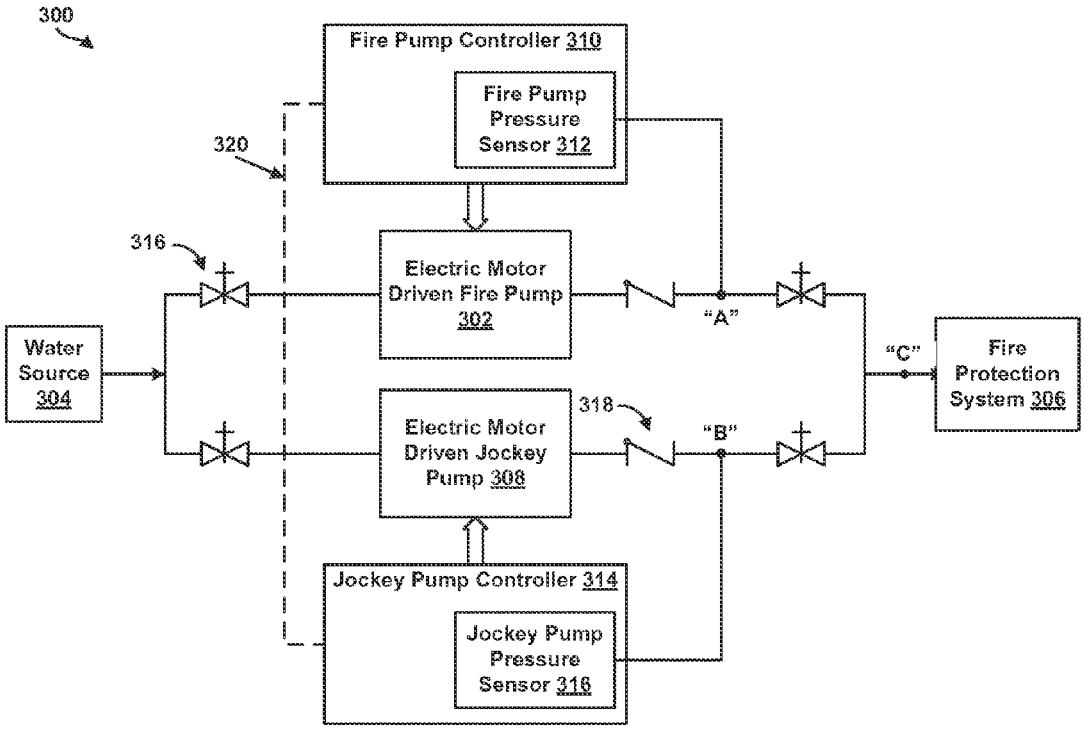
FIG. 3 is a block diagram of an example fire pump system.

FIG. 3 is a block diagram of an example fire pump system 300. The example system 300 may include the pump controller system 200 illustrated in FIG. 2, for example. The example system 300 includes a fire pump 302 that is connected to a water source 304. The water source 304 may provide water flow at a pressure to a fire protection system 306, and the fire pump 302 may be configured to provide water flow at a higher pressure to the fire protection system 306. The fire pump 302 may be powered by a number of components, including one or more of an electric motor, diesel engine, or a steam turbine. In some instances, the electrical motor may be powered using an emergency generator. In one example, the system may include multiple fire pumps (not shown).

The system 300 may also include a jockey pump 308 that may be configured to maintain pressure in the fire protection system 306 so that the fire pump 302 does not need to constantly run. For example, the jockey pump 308 may maintain pressure at an artificially high level so that the operation of a single fire sprinkler will cause a pressure drop that will be sensed by a fire pump controller 310, causing the fire pump 302 to start. In some examples, the jockey pump 308 may be smaller than the fire pump 302. For example, the jockey pump 308 may be of an appropriate size in order to make up for pressure lost due to a leakage in the fire protection system 306 within a predetermined time frame (e.g., 10 minutes).

The fire pump controller 310 may be similar to the system 200 of FIG. 2 and may be any type of fire pump controller configured to operate with the fire pump 302. For instance, the fire pump controller 310 may be an electric fire pump controller, a diesel fire pump controller, a full voltage starting fire pump controller, a wye-delta fire pump controller, among other types. Devices within the fire pump controller 310 may perform functions such as receiving signals from devices (e.g., pressure sensors, sprinkler alarm valves, or remote fire alarm equipment), and activating motor control devices to provide power to motors driving the fire pump 302. In one example, the fire pump controller 310 may receive a pressure signal from a fire pump pressure sensor 312. Additionally, the fire pump controller 310 may monitor operation and performance of the fire pump 302. Optionally, the fire pump controller may also monitor a three-phase power line to determine information associated with the three-phase power line.

The system 300 may further include a jockey pump controller 314 and jockey pump pressure sensor 316. The jockey pump controller 314 may be similar to the system 200 of FIG. 2 and may be any type of jockey pump controller configured to operate with the jockey pump 308. For example, the jockey pump controller may be full voltage starting or wye-delta reduced voltage starting.

The fire pump controller 310 and the jockey pump controller 314 may optionally include a switch to allow automatic or manual operation of the fire pump 302 and/or the jockey pump 308. Additionally, the fire pump controller 310 and the jockey pump controller 314 may include a minimum run timer to prevent short cycling of the fire pump 302 and/or the jockey pump 308. In some examples, the fire pump controller 310 and/or the jockey pump controller 314 may further include an emergency manual run mechanism to mechanically close motor contactor contacts in an emergency condition.

As described previously with reference to FIG. 2, the fire pump pressure sensor 312 of the fire pump controller 310 may be any type of pressure sensor or transducer. For instance, the fire pump pressure sensor 312 may be any type of pressure sensor which may generate a signal as a function of an imposed pressure. As shown in FIG. 3, the fire pump pressure sensor 312 may monitor pressure in the fire protection system 306 at point "A". The jockey pump pressure sensor 316 may also be any type of pressure sensor or transducer and may monitor pressure in the fire protection system at point "B".

The system 300 also includes gate valves 316 and check valves 318. Other configurations of the gate valves 316 and the check valves 318 with respect to the fire pump 302 and jockey pump 308 are also possible.

In one example, the system 300 may include a communication link 320 between the fire pump controller 310 and the jockey pump controller 314. For example, the communication link 320 may be a serial Modbus communication link with the fire pump controller 310 or the jockey pump controller 314 serving as the master. As an example, the communication link 320 may include a two-wire RS-485 link. Other example communication links are also contemplated. For instance, the communication link 320 may be a half-duplex or full-duplex parallel communication link. The example is not meant to be limiting, and the communication link 320 may include any type of wired or wireless communication link facilitating communication between the fire pump controller 310 and jockey pump controller 314 or components of the fire pump controller 310 and the jockey pump controller 314.

The communication link 320 may permit the exchange of one or more of pressures, pressure set points, or pump operation statuses, among other types of information between the fire pump controller 310 and the jockey pump controller 314. In some examples, the communication link 320 may enable the use of voting logic in each of the fire pump controller 310 and the jockey pump controller 314 to determine a course of action in case one or more of the fire pump pressure sensor 312 and the jockey pump pressure sensor 316 is malfunctioning or has failed.

As shown in FIG. 3, when the gate valves 318 are open, the fire pump pressure sensor 312 and the jockey pump pressure sensor 316 are both monitoring water pressure in the fire protection system 306 at point "C". In one example, dual modular redundancy in the automatic operation of the system 300 may be provided by running similar software routines for handling pressure signals from the fire pump pressure sensor 312 and the jockey pump pressure sensor 316 in the fire pump controller 310 and in the jockey pump controller 314 in parallel. Example methods for dual redundancy controller operation in the fire pump controller 310 and the jockey pump controller 314 are described below with respect to FIGS. 4 and 5.

Figure 4:
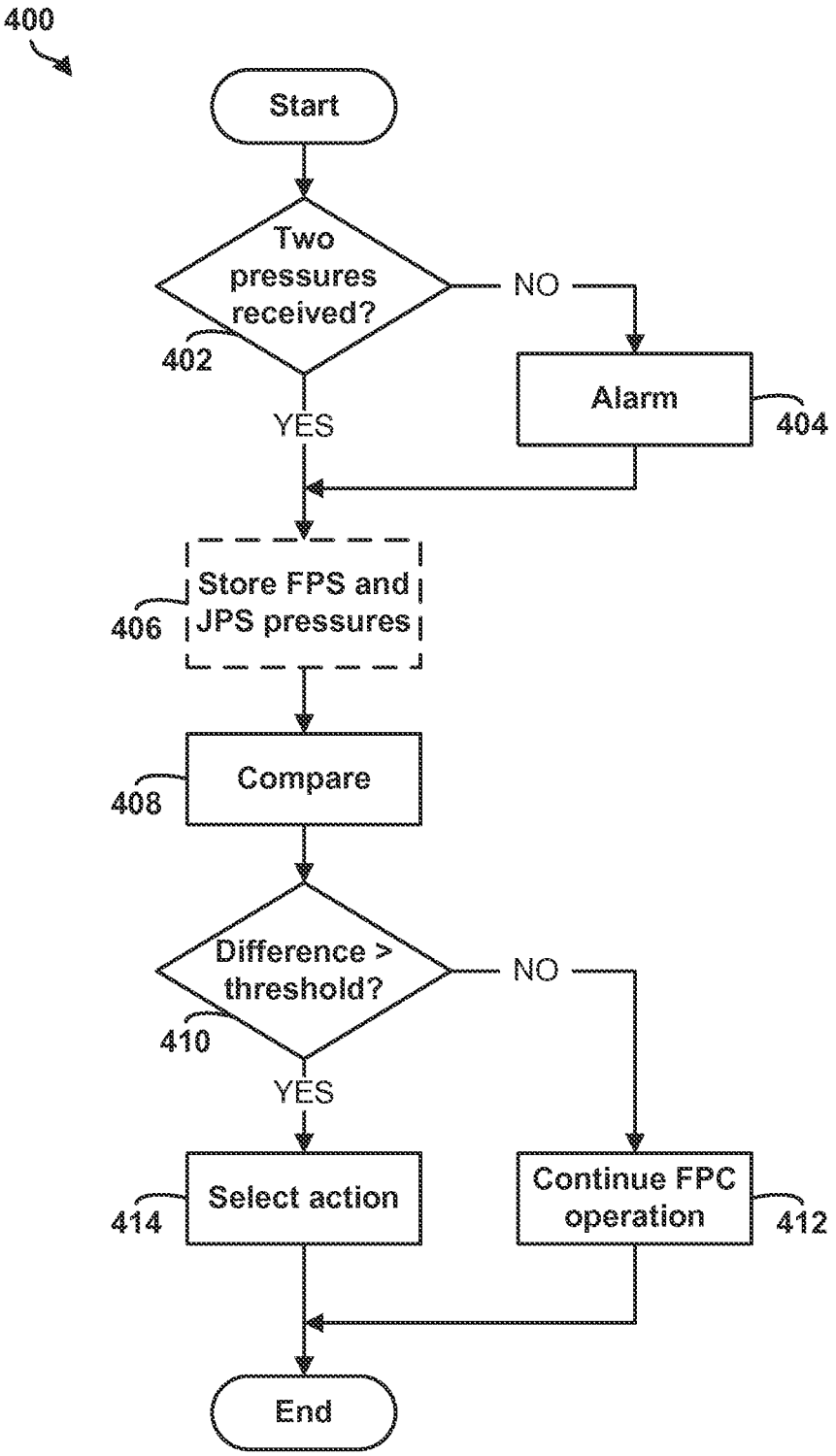
FIG. 4 is a flow chart of an example method for operating a fire pump controller.

FIG. 4 is a flow chart of an example method 400 for operating a fire pump controller. Method 400 shown in FIG. 4 presents an embodiment of a method that could be used by the system 200 of FIG. 2 or the fire pump controller 310 of FIG. 3, or components of the system 200 or the fire pump controller 310, for example. It should be understood that for this and other processes and methods disclosed herein, the flowchart shows functionality and operation of one possible implementation of present embodiments. In this regard, each block may represent a module, a segment, or a portion of program code, which includes one or more instructions executable by a processor or computing device for implementing specific logical functions or steps in the process. The program code may be stored on any type of computer readable medium, for example, such as a storage device including a disk or hard drive. The computer readable medium may include non-transitory computer readable medium, for example, such as computer-readable media that stores data for short periods of time like register memory, processor cache and random access memory (RAM). The computer readable medium may also include non-transitory media, such as secondary or persistent long term storage, like read only memory (ROM), optical or magnetic disks, or compact-disc read only memory (CD-ROM), for example. The computer readable media may also be any other volatile or non-volatile storage systems. The computer readable medium may be considered a computer readable storage medium, for example, or a tangible storage device.

In addition, for the method 400 and other processes and methods disclosed herein, each block may represent circuitry that is wired to perform the specific logical functions in the process. Alternative implementations are included within the scope of the example embodiments of the present disclosure in which functions may be executed out of order from that shown or discussed, including substantially concurrent or in reverse order, depending on the functionality involved, as would be understood by those reasonably skilled in the art.

Initially, as shown at block 402, a determination is made whether two pressures are received. For example, the fire pump controller may be configured to receive a pressure signal from a fire pump controller pressure sensor (FPS) and determine an FPS pressure based on the received pressure signal. As an example, the pressure signal may be received on a continuous basis or at predetermined intervals. Additionally, the fire pump controller may be configured to receive a pressure value from a jockey pump controller on a continuous basis or at predetermined intervals. The pressure value from the jockey pump controller may be sent to the fire pump controller via a communication link, for instance, and may be a jockey pump pressure sensor (JPS) pressure that is determined by the jockey pump controller based on a pressure signal.

A pressure signal may indicate a magnitude of water pressure within a fire protection system (such as a sprinkler system or a standpipe system). In one example, a pressure signal may indicate the magnitude, or alternatively may indicate that the pressure is above or below a threshold level, for example. Pressure values may be determined based on received pressure signals. For instance, a pressure signal may be a voltage between 1 and 5 volts and the voltage may correspond to a water pressure value based on a linear or non-linear relationship. In some examples, an analog-to-digital converter may be used to convert a pressure signal to a pressure value.

In one example, one or more of the JPS pressure or the FPS pressure may not be received. For instance, a pressure signal may not be received by either the fire pump controller of the jockey pump controller due to an interruption in a sensing line of the FPS or the JPS, or the JPS pressure may not be received due to a disruption in the communication link. In another instance, either the FPS or the JPS may be damaged or have failed such that the FPS or the JPS is no longer generating a voltage. In one example, if both a JPS pressure and an FPS pressure are not received, at block 404 a signal may be provided to an alarm. The signal may cause an alarm to be generated indicating a potential problem with one or more of the FPS, the JPS, or the communication link.

Optionally, at block 406, the determined pressures from the JPS and the FPS may be stored in a memory of the fire pump controller. In one example, if one or more of the pressure signals was not received, a pressure value of zero may be assumed and used as a placeholder for the remainder of the method 400.

At block 408, the FPS pressure and the JPS pressure may be compared to determine if the pressures are tracking together. In one example, an absolute value of the difference between the FPS pressure and the JPS pressure may be determined and compared to a predetermined threshold. In another example, an average of FPS pressures over a predetermined time frame may be compared to an average of JPS pressures over the predetermined time frame. In other instances, delta values such as a change in a determined pressure value as compared to a previous pressure value may be determined for the FPS and JPS and subsequently compared.

In some instances, a difference between the FPS pressure and the JPS pressure may be compared to a predetermined threshold, and at block 410, a decision may be made based on the comparison. For example, if the pressure difference is not greater than (i.e., less than or equal to) the predetermined threshold, this may indicate that the pressures from the JPS and FPS agree. Based on the decision, operation of the fire pump controller (FPC) may continue at block 412.

For example, the fire pump controller may determine if the FPS pressure is below a threshold level. If the FPS pressure is not below the threshold level, this may be indicative that the pressure in the fire protection system is at an acceptable level and the fire pump will not be started. If the FPS pressure is below the threshold level, the fire pump controller may initiate operation of a fire pump. In some instances, the fire pump controller may start an on-delay timer when the FPS pressure is below the threshold level and wait a predetermined time before starting the fire pump to avoid starting the fire pump in cases of minor pressure changes or fluctuations (e.g., another FPS pressure may be subsequently determined that is above the threshold level prior to expiration of the on-delay timer and the fire pump may not be started).

Additionally, if the fire pump is started, the fire pump controller may monitor the FPS pressure to determine whether the FPS pressure has been increased above the threshold level by the fire pump, indicating that the fire pump may be stopped. In some examples, the fire pump controller may also initiate a minimum run timer that must expire before the fire pump controller may be stopped to avoid unnecessary cycling of the fire pump.

In some examples, the decision at block 410 may determine that the difference between the FPS pressure and the JPS pressure is above the predetermined threshold. This may be indicate that either the FPS or the JPS is malfunctioning, and an appropriate action for the fire pump and/or the jockey pump may be selected at block 414. In some examples, an operator of the fire pump controller may specify or choose a course of action for the fire pump controller in the event of a malfunction of the FPS or JPS. For example, the operator may choose an action from among the following example actions using an interface of the fire pump controller: generate a pressure trouble alarm; start the fire pump; generate an alarm and start the fire pump; generate an alarm and command the jockey pump controller to start the jockey pump; generate an alarm and start the fire pump if either the FPS pressure or the JPS pressure are below a pressure set point of the fire pump controller; etc. In some instances, a generated alarm may be indicative that either the FPS or the JPS is malfunctioning.

An action selected by an operator may be stored in a memory of the fire pump controller as a configuration setting. The memory may also include a default action(s) for the configuration setting. At block 414, the action may be retrieved from the memory. In an example in which the action does not involve a comparison of the FPS pressure or the JPS pressure with the fire pump pressure set point or the jockey pump pressure set point, the action may be executed by the fire pump controller. In other examples, the determined FPS pressure and/or JPS pressure may be compared with the fire pump pressure set point or jockey pump pressure set point before the action is executed. For example, if both the FPS pressure and the JPS pressure are above the fire pump pressure set point, a pressure trouble alarm may be generated but the fire pump may not be started.

In a further example, if at block 410 the difference is less than or equal to the predetermined threshold, the fire pump controller may also compare the JPS pressure to a jockey pump pressure set point (not shown). For example, the fire pump controller may receive a jockey pump pressure set point and jockey pump operation status (e.g., run, off, idle, etc.) via the communication link. If the JPS pressure is below the jockey pump pressure set point and the jockey pump is not running (i.e., idle or off), the fire pump controller may generate a pressure trouble alarm and/or command the jockey pump controller to start the jockey pump based on information selected by an operator and stored in another configuration setting.

Figure 5:
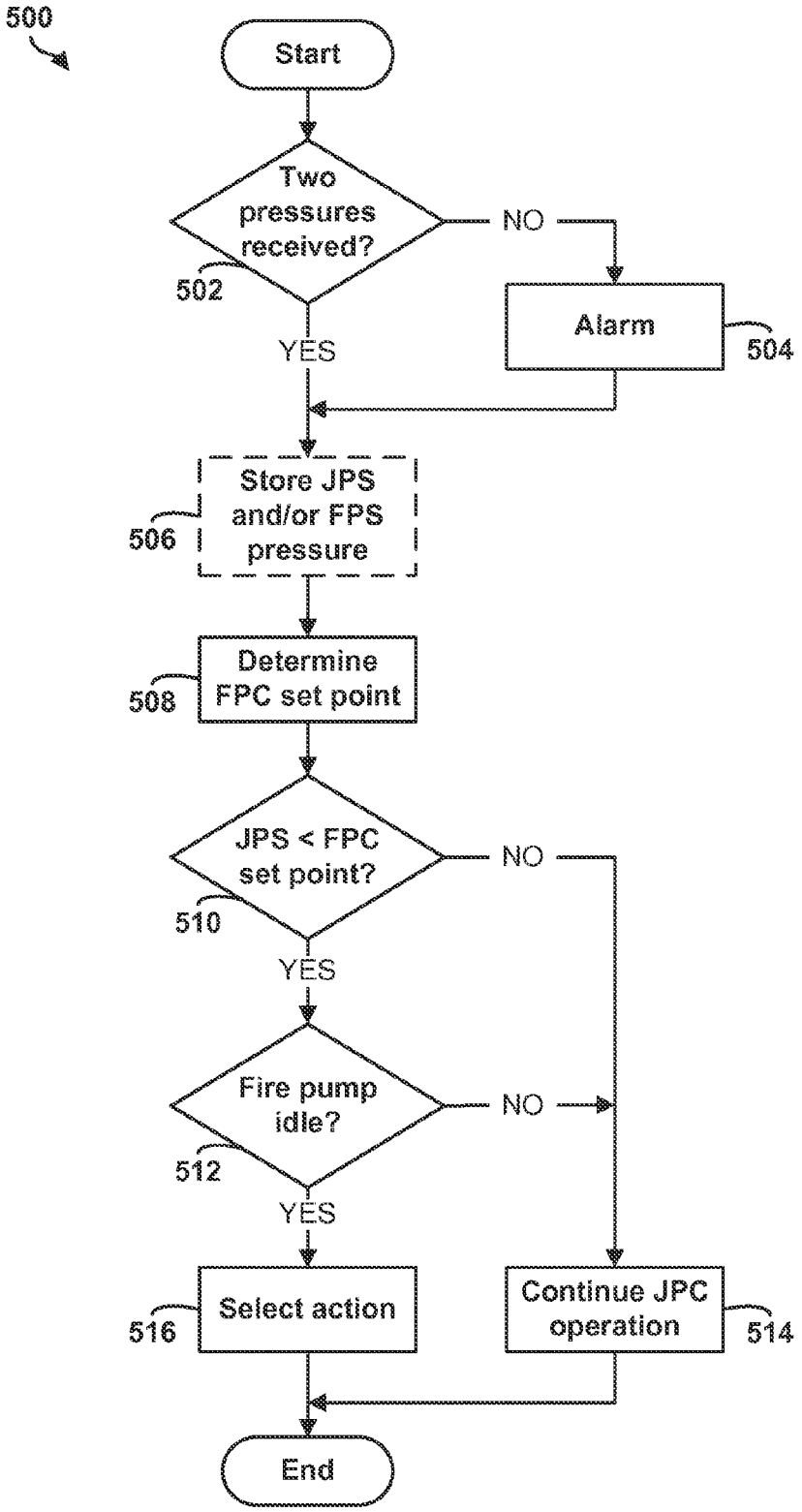
FIG. 5 is a flow chart of an example method for operating a jockey pump controller.

In some instances, the method 400 may increase reliability in a fire pump system by allowing control of the fire pump to not solely rely on the use of the FPS as the single pressure sensor for starting the fire pump. Operation of the jockey pump controller of the system 300 may also be configured to increase reliability. FIG. 5 is a flow chart of an example method 500 for operating a jockey pump controller. Method 500 shown in FIG. 5 presents an embodiment of a method that could be used by the system 200 of FIG. 2 or the jockey pump controller 314 of FIG. 3, or components of the system 200 or the jockey pump controller 314, for example.

Method 500 may include one or more operations, functions, or actions as illustrated by blocks of the flow chart. Although the blocks are illustrated in a sequential order, these blocks may also be performed in parallel, and/or in a different order than those described herein. Also, the various blocks may be combined into fewer blocks, divided into additional blocks, and/or removed from the flow chart, based upon the desired implementation of the method 500. Each block may represent a module, a segment, or a portion of program code, which includes one or more instructions executable by a processor for implementing specific logical functions or steps in the process. In addition, each block in FIG. 5 may represent circuitry that is wired to perform the specific logical functions in the process.

Initially, at block 502, a determination is made whether two pressures are received. For example, the jockey pump controller may be configured to receive a pressure signal from a jockey pump pressure sensor (JPS) and determine a JPS pressure based on the received pressure signal. As an example, the pressure signal may be received on a continuous basis or at predetermined intervals. Additionally, the jockey pump controller may be configured to receive a pressure value from a fire pump controller on a continuous basis or at predetermined intervals. The pressure value from the fire pump controller may be sent to the jockey pump controller via a communication link, for instance, and may be a fire pump pressure sensor (FPS) pressure that is determined by the fire pump controller based on a pressure signal. In some examples, the JPS pressure or FPS pressure may be a voltage between 1 and 5 volts that corresponds to a water pressure value. In other instances, the JPS pressure or FPS pressure may be magnitudes of water pressure.

In one example, one or more of the JPS pressure or the FPS pressure may not be received. For instance, a pressure signal may not be received by either the jockey pump controller or the fire pump controller due to an interruption in a sensing line of the FPS or the JPS, or the FPS pressure may not be received due to a disruption in the communication link. In another instance, either the FPS or the JPS may be damaged or have failed such that the FPS or the JPS is no longer generating a voltage or generating an inaccurate voltage. In one example, if both a JPS pressure and an FPS pressure are not received, at block 504, a signal may be provided to an alarm. The signal may cause an alarm to be generated indicating a potential problem with one or more of the FPS, the JPS, or the communication link.

Optionally, at block 506, the determined pressures from the JPS and the FPS may be stored in a memory of the jockey pump controller. In one example, if one or more of the pressure signals was not received, a pressure value of zero may be assumed and used as a placeholder for the remainder of the method 500.

At block 508, a pressure set point for the fire pump controller (FPC) may be determined. For example, the pressure set point may be a start pressure set point at which a fire pump is configured to be started if the FPS pressure is below the pressure set point. In one example, the pressure set point may be received from the fire pump controller via the communication link and stored in a memory of the jockey pump controller. The jockey pump controller may access the memory to determine the pressure set point. In another example, the pressure set point may be provided via an interface of the jockey pump controller or an interface of the fire pump system and the pressure set point may be stored in a memory of the jockey pump controller.

A decision may be made, at block 510, based on a relationship between the FPC pressure set point and the JPS pressure. For example, a determination may be made whether the JPS pressure is below the FPC pressure set point. In one instance, if the JPS pressure is above the pressure set point (or greater than or equal to the pressure set point), operation of the jockey pump controller may continue at block 514.

As an example, the JPS pressure may be less than the FPC pressure set point and the jockey pump controller may perform additional actions at block 514. In one instance, the jockey pump controller may determine if the JPS pressure is below a pressure set point of the jockey pump controller. If the JPS pressure is not below the jockey pump controller pressure set point, this may be indicative that the pressure in the fire protection system is at an acceptable level and the jockey pump will not be started. If the JPS pressure is below the jockey pump controller pressure set point, the jockey pump controller may initiate operation of the jockey pump. In some instances, the jockey pump controller may start an on-delay timer when the JPS pressure is below the pressure set point of the jockey pump controller and wait a predetermined time before starting the jockey pump to avoid starting the jockey pump in cases of minor pressure changes or fluctuations (e.g., another JPS pressure may be subsequently determined that is above the pressure set point prior to expiration of the on-delay timer and the jockey pump may not be started).

Additionally, if the jockey pump is started, the jockey pump controller may monitor the JPS pressure to determine whether the JPS pressure has been increased above the pressure set point by the jockey pump, indicating that the jockey pump may be stopped. In some examples, the jockey pump controller may also initiate a minimum run timer that must expire before the jockey pump controller may be stopped to avoid unnecessary cycling of the jockey pump.

In one example, the decision at block 510 may determine that the JPS pressure is below the pressure set point of the fire pump controller. In response, another decision may be made at block 512. The decision at block 512 may determine whether the fire pump is idle. For instance, the jockey pump controller may receive a fire pump operation status from the fire pump controller via the communication link indicating if the fire pump is running or is idle. If the pump operation status indicates that the fire pump is running, the method 400 may proceed to block 514. If the pump operation status indicates the fire pump is idle, at block 516, an action for the fire pump and/or the jockey pump may be selected.

In some examples, an operator of the jockey pump controller or fire pump controller may specify or choose a course of action for the fire pump controller in the event of a malfunction of the JPS or FPS or failure of the fire pump to start when the JPS is below the pressure set point of the fire pump controller. For example, the operator may choose an action from among the following example actions using an interface of the fire pump controller, the jockey pump controller, or the fire pump system: generate an alarm; generate an alarm and command the fire pump controller to start the fire pump; generate an alarm and start the jockey pump; etc.

According to the method 500, in an instance in which the pressure in the fire protection system has fallen below the pressure set point of the fire pump controller and the drop in pressure is not detected by the fire pump controller (e.g., due to a failure of the FPS), the fire pump may still be started due to a command sent from the jockey pump controller to the fire pump controller via the communication link.

In some instances, the generated alarm may be indicative that the FPS is malfunctioning. An action selected by the operator may be stored in a memory of the jockey pump controller as a configuration setting. The memory may also include a default action(s) for the configuration setting. At block 516, the jockey pump controller may retrieve the action from the memory and execute the action.

Figure 6:
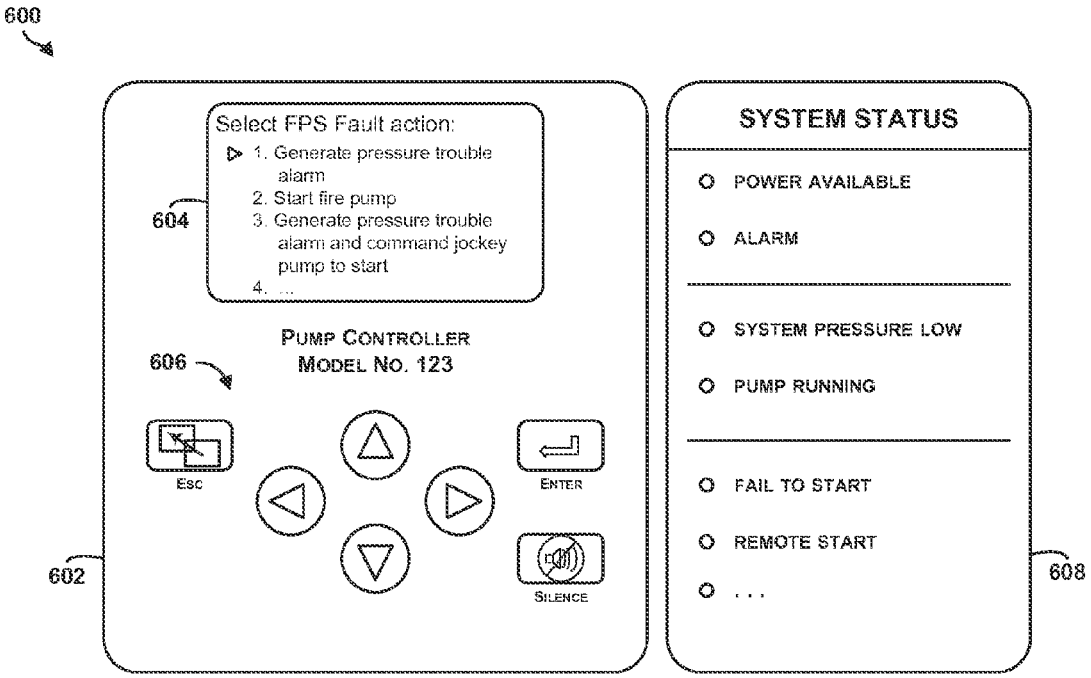
FIG. 6 is an example pump controller interface.

FIG. 6 is an example pump controller interface 600. In some examples, the interface 600 may be used by an operator to select a course of action for a fire pump controller and/or a jockey pump controller in the event of a failure of either a fire pump pressure sensor or jockey pump pressure sensor. The interface may be coupled to a fire pump controller or jockey pump controller, for example, or may be provided at a location remote from a fire pump system. The interface 600 may include an electronic control board 602 having a display 604 and a keypad 606, and an alarm panel 608.

In one example, the display 604 may be a backlit, liquid crystal (LCD) display. For example, the display 604 may be a monochrome or multi-chromatic dot matrix 128×64 LED display. Other example sizes are also possible. The display 604 may be configured to display customized graphics and/or characters. For instance, the display 604 may provide information associated with time and date, system pressure, pump operation timers, three-phase power supply line voltages, etc. In some examples, the display 604 may provide text messages for the statistics or alarm conditions for one or more of the following: motor on, minimum run time, off delay time, fail to start, under voltage, locked rotor trip, emergency start, drive not installed, disk error, disk near full, sequential start time, local start, remote start, system battery low, over voltage, over frequency, motor over 320%, motor overload, printer error, pressure error, etc.

The keypad 606 may enable a user or operator to access controls or stored information of the pump controller. For example, the keypad 606 may be used to navigate a graphical user interface including a home menu and multiple submenus. In one example, a user may navigate to a submenu using the keypad 606 to choose a configuration setting for the pump controller. As shown in FIG. 6, the display 604 may provide a number of options for a user to choose from in the event of a fire pump pressure sensor (FPS) failure. In other instances, the user may select a different configuration setting for the event of a jockey pump pressure sensor failure. For instance, if a fire pump system is monitored by an operator, a user may choose option 1 to generate a pressure trouble alarm. However, in other instances, a user may choose option 2 to automatically start the fire pump in the event of a fire pump pressure sensor fault. In some examples, a user may choose separate actions for a fire pump controller or jockey pump controller based on a time of day or other conditions depending on a desired configuration.

The alarm panel 608 may comprise a plurality of LEDs configured to indicate system status or alarm conditions. In some instances, one or more of the LEDs may be capable of displaying a red, green, or yellow light based on various conditions determined by a microprocessor of a pump controller. For instance, a color or illumination of an LED of the plurality of LEDs may indicate one or more of the following: power available, pump running, remote start, deluge open, phase failure, interlock on, motor overload, automatic shutdown disabled, overvoltage, alarm, system pressure low, transfer switch normal, transfer switch emergency, phase reversal, fail to start, emergency isolation switch off, undervoltage, etc.

Figure 7:
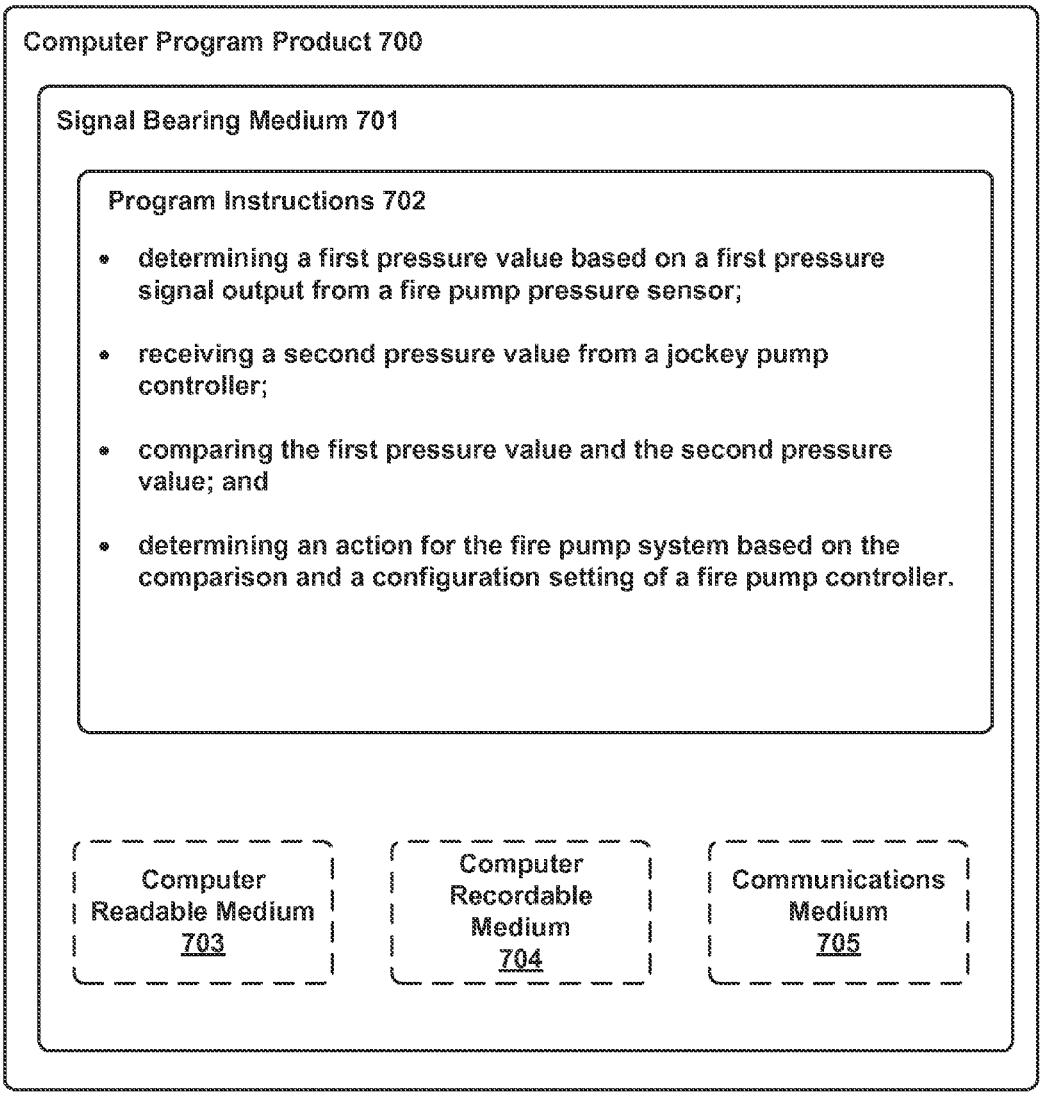
FIG. 7 is a schematic illustrating a conceptual partial view of an example computer program product that includes a computer program for executing a computer process on a computing device, arranged according to at least some embodiments presented herein.

In some embodiments, the disclosed methods may be implemented as computer program instructions encoded on a non-transitory computer-readable storage media in a machine-readable format, or on other non-transitory media or articles of manufacture. FIG. 7 is a schematic illustrating a conceptual partial view of an example computer program product 700 that includes a computer program for executing a computer process on a computing device, arranged according to at least some embodiments presented herein.

In one embodiment, the example computer program product 700 is provided using a signal bearing medium 701. The signal bearing medium 701 may include one or more programming instructions 702 that, when executed by one or more processors may provide functionality or portions of the functionality described above with respect to FIGS. 1-6. In some examples, the signal bearing medium 701 may encompass a computer-readable medium 703, such as, but not limited to, a hard disk drive, a Compact Disc (CD), a Digital Video Disk (DVD), a digital tape, memory, etc. In some implementations, the signal bearing medium 701 may encompass a computer recordable medium 704, such as, but not limited to, memory, read/write (R/W) CDs, R/W DVDs, etc. In some implementations, the signal bearing medium 701 may encompass a communications medium 705, such as, but not limited to, a digital and/or an analog communication medium (e.g., a fiber optic cable, a waveguide, a wired communications link, a wireless communication link, etc.). Thus, for example, the signal bearing medium 701 may be conveyed by a wireless form of the communications medium 705 (e.g., a wireless communications medium conforming with the IEEE 802.11 standard or other transmission protocol).

The one or more programming instructions 702 may be, for example, computer executable and/or logic implemented instructions. In some examples, a computing device such as components of FIG. 3 may be configured to provide various operations, functions, or actions in response to the programming instructions 702 conveyed to the fire pump controller 310 or the jockey pump controller 314 by one or more of the computer readable medium 703, the computer recordable medium 704, and/or the communications medium 705.

It should be understood that arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims, along with the full scope of equivalents to which such claims are entitled. It is also to be understood that the terminology used herein is for the purpose of describing particular embodiments only, and is not intended to be limiting.

What is claimed is:

1. A fire pump control system comprising:

a jockey pump controller configured to control operation of a jockey pump, wherein the jockey pump controller is configured to determine a first pressure value based on an output of a jockey pump pressure sensor; and a fire pump controller configured to control operation of a fire pump, wherein the fire pump controller is configured to:

receive the first pressure value from the jockey pump controller;

determine a second pressure value based on an output of a fire pump pressure sensor; and determine a first predetermined action based on a comparison of the first pressure value and the second pressure value;

wherein the jockey pump controller is further configured to select a second predetermined action for the fire pump control system based on a second comparison of the first pressure value and a pressure set point for the fire pump controller.

2. The fire pump control system of claim 1, wherein the fire pump controller is further configured to determine whether a difference between the first pressure value and the second pressure value is greater than a threshold value.

3. The fire pump control system of claim 1, wherein the first predetermined action is selected based on the comparison of the first pressure value and the second pressure value and a configuration setting of the fire pump controller, wherein the configuration setting specifies one or more actions for the fire pump controller that are associated with one or more relationships between the first pressure value and the second pressure value.

4. The fire pump control system of claim 1, wherein the first predetermined action comprises providing a pressure alarm.

5. The fire pump control system of claim 1, wherein the first predetermined action comprises initiating operation of the fire pump.

6. The fire pump control system of claim 1, wherein the first predetermined action comprises providing a command to the jockey pump controller for initiating operation of the jockey pump when the second pressure value is less than a pressure set point for the jockey pump controller and the jockey pump is idle.

7. The fire pump control system of claim 1, wherein the jockey pump controller is further configured to determine whether the first pressure value is less than the pressure set point for the fire pump controller and whether the fire pump is idle.

8. The fire pump control system of claim 7, wherein the another first predetermined action comprises providing a command to the fire pump controller for initiating operation of the fire pump when the first pressure value is less than the pressure set point for the fire pump controller and the fire pump is idle.

9. The fire pump control system of claim 1, wherein the another first predetermined action comprises providing a second pressure alarm, wherein the second pressure alarm is indicative that the fire pump pressure sensor is malfunctioning.

10. The fire pump control system of claim 1, wherein the fire pump controller and the jockey pump controller are configured to communicate via a wired communication link.

* * * * *